US011767732B2

(12) United States Patent
Harms

(10) Patent No.: US 11,767,732 B2
(45) Date of Patent: Sep. 26, 2023

(54) SYSTEMS AND METHODS FOR PLUGGING A WELL

(71) Applicant: Halliburton Energy Services, Inc., Houston, TX (US)

(72) Inventor: Timothy Edward Harms, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/215,227

(22) Filed: Mar. 29, 2021

(65) Prior Publication Data

US 2022/0307341 A1 Sep. 29, 2022

(51) Int. Cl.

| | |
|---|---|
| ***E21B 33/13*** | (2006.01) |
| ***E21B 47/06*** | (2012.01) |
| ***E21B 43/119*** | (2006.01) |
| ***E21B 23/06*** | (2006.01) |

(52) U.S. Cl.

CPC ..... *E21B 33/13* (2013.01); *E21B 23/06* (2013.01); *E21B 43/119* (2013.01); *E21B 47/06* (2013.01)

(58) Field of Classification Search

CPC ..... E21B 33/13; E21B 23/06; E21B 43/119; E21B 47/06

See application file for complete search history.

(56) References Cited

U.S. PATENT DOCUMENTS

| | | | |
|---|---|---|---|
| 4,823,882 | A | 4/1989 | Stokley |
| 5,048,613 | A | 9/1991 | Shilling |
| 6,382,315 | B1 | 5/2002 | Langseth |
| 7,665,535 | B2 | 2/2010 | Van Wulfften Palthe |
| 9,518,443 | B2 | 12/2016 | Tunget |
| 10,053,969 | B2 | 8/2018 | Castillo |
| 10,151,164 | B2 | 12/2018 | Bennett |

(Continued)

FOREIGN PATENT DOCUMENTS

| | | | |
|---|---|---|---|
| CN | 111255420 | A | 6/2020 |
| EP | 3036395 | B1 | 7/2017 |
| WO | 2018140871 | A1 | 8/2018 |

OTHER PUBLICATIONS

International Searching Authority, International Search Report and Written Opinion dated Dec. 15, 2021 for corresponding PCT Application No. PCTUS2021024831 filed Mar. 30, 2021.

(Continued)

*Primary Examiner* — Crystal J. Lee
(74) *Attorney, Agent, or Firm* — K&L Gates LLP

(57) ABSTRACT

A plugging system for plugging a cased well in a single trip downhole. The plugging system may include a tool string positionable within the cased well and including a bore and a downhole tool coupled to the tool string. The downhole tool may include a first perforating gun, an upper resettable packer, a lower resettable packer, and a flow-through assembly. The first perforating gun may be operable to perforate the casing of the cased well. When the downhole tool is positioned in the cased well, the upper resettable packer may be uphole of the first perforating gun. When the downhole tool is positioned in the cased well, the lower resettable packer may be downhole of the first perforating gun. The flow-through assembly may be positioned between the upper resettable packer and the lower resettable packer and operable to flow fluids into a bore of the cased well.

20 Claims, 5 Drawing Sheets

(56) References Cited

U.S. PATENT DOCUMENTS

| | | | | |
|---|---|---|---|---|
| 2008/0314591 | A1* | 12/2008 | Hales | E21B 33/124 166/285 |
| 2009/0301720 | A1 | 12/2009 | Edwards | |
| 2013/0048273 | A1 | 2/2013 | Crow | |
| 2016/0032687 | A1 | 2/2016 | Cong | |
| 2017/0067313 | A1 | 3/2017 | Connell | |
| 2017/0234102 | A1 | 8/2017 | Svartvatn | |
| 2020/0232300 | A1* | 7/2020 | Hess | E21B 33/165 |

OTHER PUBLICATIONS

Torbjorn Vralstad, Plug & abandonment of offshore wells: Ensuring long-term well integrity and cost-efficiency, 2019, 478-491, 173, Journal of Petroleum Science and Engineering.

* cited by examiner

SYSTEMS AND METHODS FOR PLUGGING A WELL

BACKGROUND

After an oil or gas well is drilled, it may become desirable to abandon the well if production is no longer possible or economical. It is common practice to plug the well before abandonment to close zones and prevent migration of hydrocarbon fluids. Plugging may be achieved by injecting a settable substance, such as cement, into the well. For example, a well will sometimes have production perforations in production tubing and/or casing of the well, through which hydrocarbons enter from the surrounding formations and travel to the surface.

Pulling production tubing and casing out of the well during abandonment is often expensive due to rig use or may not be possible due to rig unavailability. Some plug and abandonment operations leave casing in place by sealing production perforations with cement to form a flow barrier to prevent influx into the casing and flow uphole, including through any tubing present. In other examples, the casing can be perforated at a specific location before placing a cement plug across the annulus and casing.

However, even when casing is left in place, plugging and abandonment operations typically require multiple downhole tools and, thus, multiple trips downhole to the desired location. Additionally, when conducted offshore, a drilling rig is needed to perform many of the plugging and abandonment operations. Accordingly, such operations are often time-consuming and costly.

BRIEF DESCRIPTION OF THE DRAWINGS

Embodiments of the systems for plugging a well are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure provides systems for plugging a well. The system allows for a well to be plugged in a single trip of a downhole tool. The elimination of multiple trips downhole with different tools allows for a reduction in time and cost for plugging the well. Further, the system can be deployed without the use of a rig, further reducing the costs involved with plugging a well.

A subterranean formation containing oil or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one borehole having a borehole wall. A borehole can include vertical, inclined, and horizontal portions, and it can be straight, curved, or branched. As used herein, the term "borehole" includes any cased, and any uncased, open-hole portion of the borehole. Further, the term "uphole" refers a direction that is towards the surface of the well, while the term "downhole" refers a direction that is away from the surface of the well.

Figure 1:
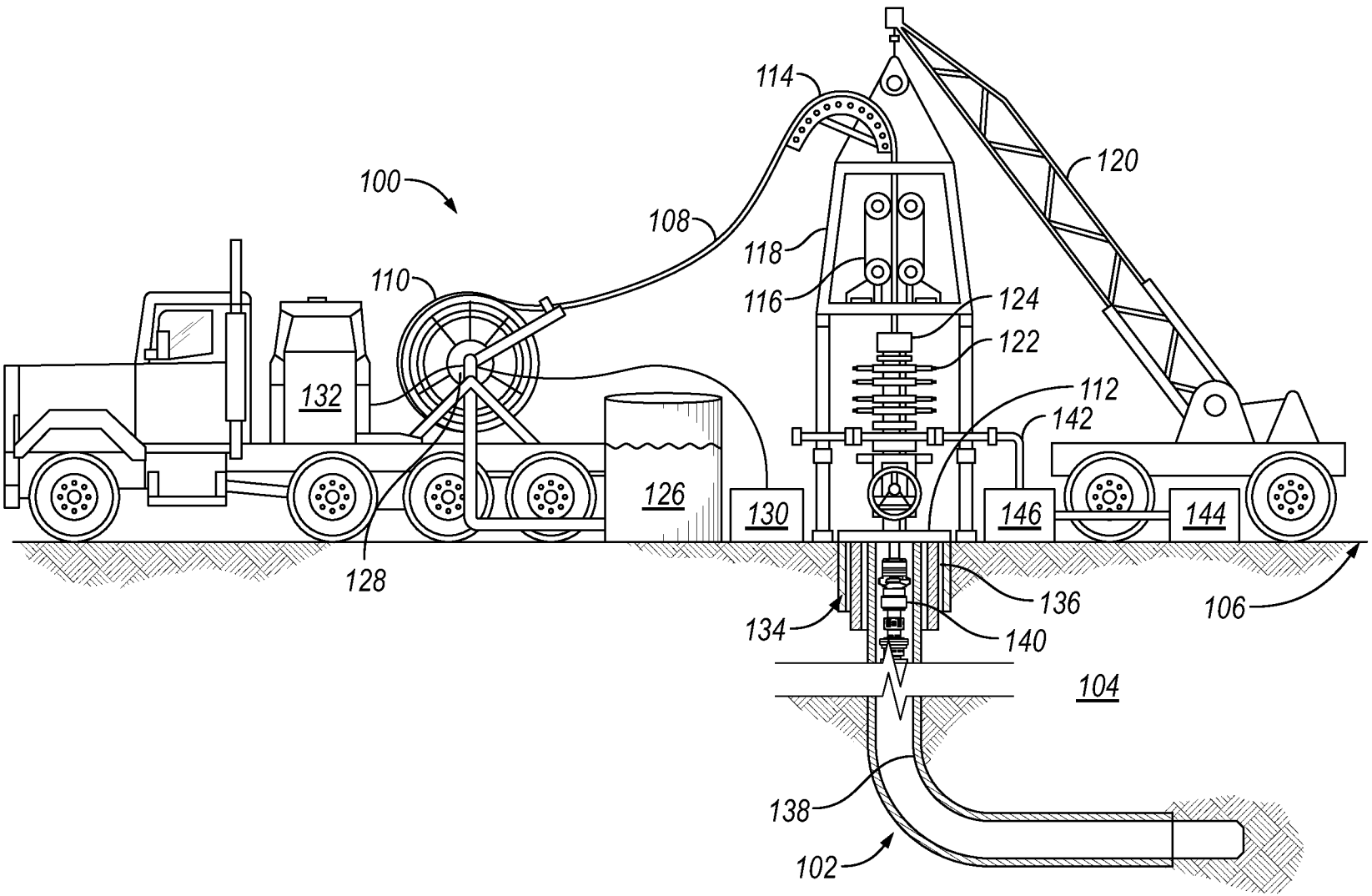
FIG. 1 is a schematic view of a plugging system, according to one or more embodiments.

FIG. 1 is a plugging system 100, according to one or more embodiments. The exemplary plugging system 100 is utilized to create a cement plug within a cased borehole 102 extending through various earth strata in an oil and gas formation 104 located below the earth's surface 106. The borehole 102 may be formed of a single or multiple bores extending into the formation 104, and disposed in any orientation. Once set, the cement plug seals the borehole to prevent formation fluids from reaching the surface once production of hydrocarbons from the well has ceased.

The plugging system 100 utilizes a tool string, such as a coiled tubing system 108, as described in more detail below, to conduct various drilling, production, and well intervention operations. The coiled tubing system 108 is stored on one or more reels 110 positioned near a wellhead 112. A tube guide 114 guides the coiled tubing of the coiled tubing system 108 into an injector 116 supported on a frame assembly 118 and positioned above the wellhead 112. The tube guide 114 is used to feed and direct the coiled tubing of the coiled tubing system 108 into and out of the borehole 102. The injector 116 and the frame assembly 118 may be suspended by a conventional derrick (not shown), a support frame (not shown), or a crane 120; however, none of these structures are required when utilizing the plugging system 100.

The coiled tubing of the coiled tubing system 108 extends through a blowout preventer (BOP) stack 122 connected to the wellhead 112 for pressure control of the borehole 102. The BOP stack 122 may include one or more BOPs. In some applications, such as, but not limited to wells having equalized pressure within the well or low bottom hole reservoir pressure, with the BOP stack 122 may be omitted. Positioned atop the BOP stack 122 is a lubricator mechanism or one or more stuffing boxes 124, which provides the primary operational seal about the outer diameter of the coiled tubing of the coiled tubing system 108 for the retention of any pressure that may be present at or near the surface of the borehole 102. Although a land-based plugging system 100 is depicted in FIG. 1, the coiled tubing system 108 can be deployed from floating rigs, jackups, platforms, subsea wellheads, or any other well location.

A working or service fluid source 126, such as a storage tank or vessel, supplies a working fluid to the coiled tubing system 108. In particular, the fluid source 126 is in fluid communication with a fluid swivel 128 secured to reel 110 and in fluid communication with the interior of coiled tubing system 108. The fluid source 126 may supply any fluid utilized in well operations including, without limitation, cement slurry, drilling fluid, acidizing fluid, liquid water, steam, nitrogen, or some other type of fluid.

The fluid source 126 may be in fluid communication with a pumping system (not shown) that pressurizes the working fluid at a select pressure, such as during high pressure pumping operation. The fluid source 126 may likewise be in communication with other surface equipment, such as mixers, blenders and the like, utilized to prepare fluids for pumping downhole via the fluid source 126. The fluid source 126 and/or surface equipment may be adjustable in real time responsive to communications during various well operations.

The plugging system 100 may also include a power supply 130 and a communications hub 132 for sending signals and/or power and otherwise controlling the well operations via electric and/or optic cable deployed within the coiled tubing system 108.

The well includes one or more casing strings 134 that are cemented in borehole 102, such as the surface, intermediate and production casings 134. An annulus 136 is formed between the walls of sets of adjacent tubular components, such as concentric casing strings 134 or the exterior of the coiled tubing system 108 and the inside wall 138 of borehole 102 or the casing string 134, as the case may be. As shown in FIG. 1, a downhole tool 140 is suspended from the coiled tubing system 108 to plug the well. The downhole tool 140 may be sized to pass through the BOP stack as it is lowered downhole. Alternatively, the BOP stack may not be present and the coiled tubing may include a wellhead connector that engages with the wellhead 112 as the downhole tools is lowered downhole.

Figure 2:
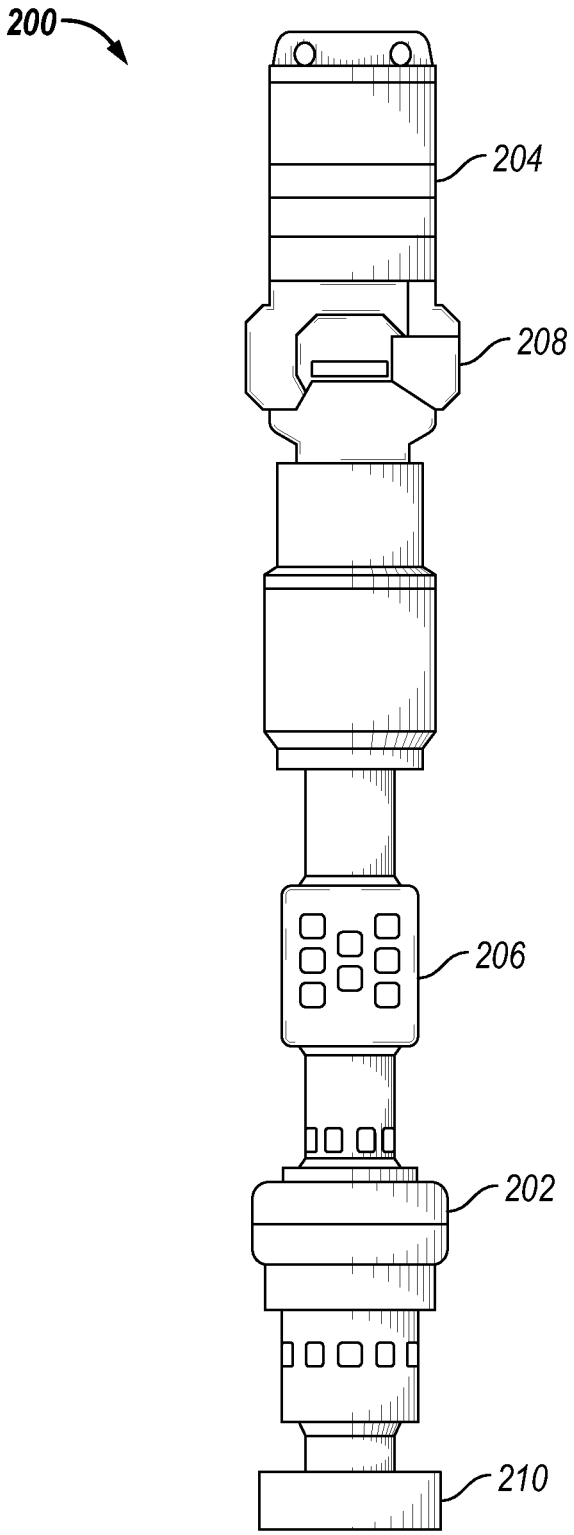
FIG. 2 is a schematic view of a downhole tool, according to one or more embodiments.

Turning now to FIG. 2, FIG. 2 is a schematic view of a downhole tool 200, according to one or more embodiments. As described above, the downhole tool 200 is lowered into a cased borehole via a tool string that includes coiled tubing, piping, or other similar means to create a cement plug to seal the borehole. The downhole tool includes upper and lower resettable packers 202, 204 and a perforating gun 206 positioned between the isolation packers.

The perforating gun 206 of the downhole tool 200 includes at least two sets of charges that, when detonated via a signal from the surface, perforate the casing surrounding the downhole tool 200. As described in more detail below, the two sets of charges within the perforating gun 206 may be detonated at different times to perforate a casing in different locations using a single perforating gun 206.

The downhole tool further includes a flow-through assembly 208. The flow-through assembly 208 is in fluid communication with pumping equipment on the surface via the coiled tubing or piping that positions the downhole tool 200 within the borehole. The flow-through assembly 208 includes a crossover or similar device that is operable to open and close a flowpath between the downhole tool 200 and the cased borehole. The flow-through assembly 208, when opened, allows cement to be pumped downhole, through the downhole tool 200, and into a cased borehole via the downhole tool 200. Accordingly, the flow-through assembly 208 allows a single downhole tool 200 to be utilized in both perforating the casing of the borehole and creating the cement plug within the borehole. Therefore, the time involved with creating the cement plug is decreased when compared to traditional plugging operations that require multiple downhole tools to be positioned downhole at different times.

The downhole tool 200 also includes a detachable isolation packer 210 on the downhole end of the downhole tool 200. Once the desired location within the borehole is reached, the detachable isolation packer 210 is set within the borehole and released from the downhole tool. As described in more detail below, the detachable isolation packer 210 acts as a lower fluid barrier during the plugging process.

Figure 3:
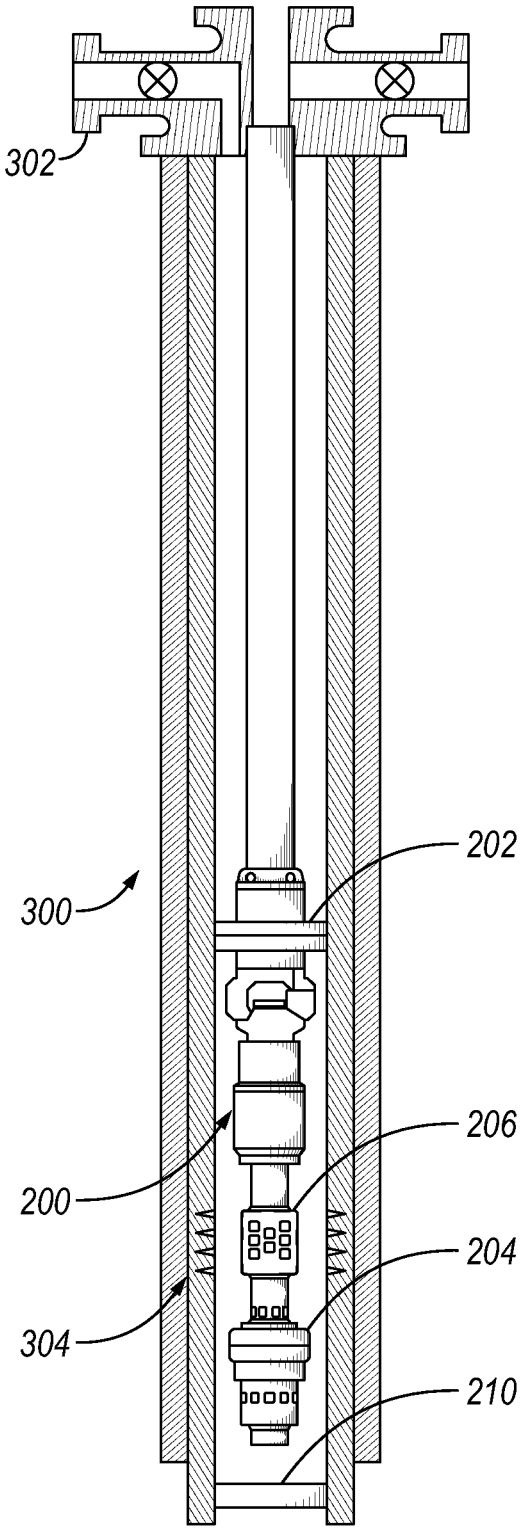
FIG. 3 is a schematic view of the downhole tool of FIG. 2 positioned in a cased well.

Turning now to FIG. 3, FIG. 3 is a schematic view of the downhole tool 200 of FIG. 2 positioned in a cased well 300. As described above, the downhole tool 200 is positioned within the cased well 300 via coiled tubing, which includes a wellhead connector 302 that engages with a wellhead, such as the wellhead 112 of FIG. 1. In applications where there is equalized pressure or low bottom hole reservoir pressure, the wellhead connector 302 may be omitted.

In operation, the downhole tool 200 is lowered into position within the cased well and the detachable isolation packer 210 is set within the cased well 300 to act as a fluid barrier. Alternatively, the detachable isolation packer 210 may be omitted because a fluid barrier is already present or the bottom of the cased well 300 acts as the fluid barrier. Once the detachable isolation packer 210 is set and released, the downhole tool 200 is raised uphole into a first perforation location 304.

Once the first perforation location 304 is reached, the upper resettable packer 202 is set within the cased well 300 to center the downhole tool 200 and stabilize the downhole tool 200 during the perforation process. Specifically, an electronic signal or pressurized hydraulic fluid is sent downhole to set the isolation packers 202 once the downhole tool 200 reaches the desired location within the borehole. After the upper resettable packer 202 is set, the first set of charges within the perforating gun 206 are detonated to perforate the casing at the first perforation location 304.

Figure 4:
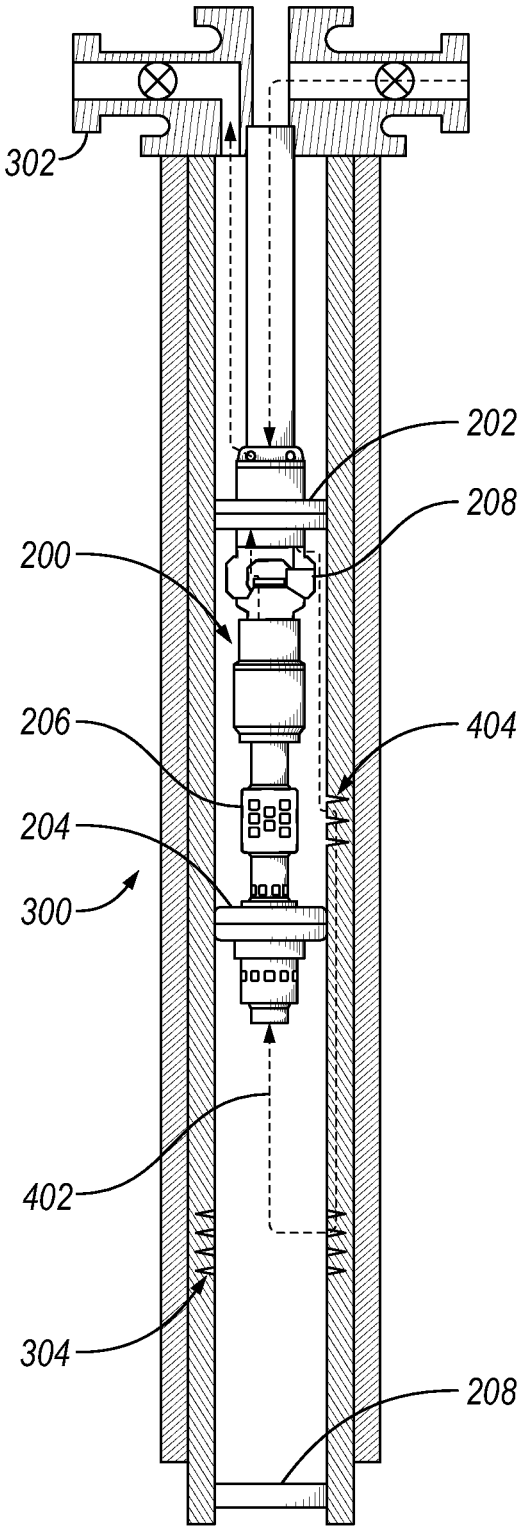
FIG. 4 is a schematic view of the downhole tool of FIG. 3 at a second location in the cased well.

After detonating the first set of charges, the upper resettable packer 202 is retracted and the downhole tool 200 is raised uphole to a second perforation location 400, as shown in FIG. 4. Once the second perforation location 400 is reached, both the upper and lower resettable packers 202, 204 are set with the cased well 300.

After the upper and lower resettable packers 202, 204 are set within the cased well 300, the second set of charges in the perforation gun are detonated to perforate the casing at the second perforation location 400. Cement is then pumped downhole through the coiled tubing string, out of the flow-through assembly 208, and into the borehole.

As shown in FIG. 4, once the cement is pumped downhole, a circulation path 402 is established through the perforations at the perforation locations 304, 404 to form the cement plug in the cased well. After a sufficient volume of cement is pumped downhole to form the plug, the upper and lower packers are retracted and the downhole tool 200 is moved uphole and/or withdrawn from the cased well. After the cement is set, it is pressure tested and may then be used as a lower fluid barrier for further cement plugs to be installed within the well via the downhole tool 200 and methods described above. In one or more embodiments, the downhole 200 conducts the pressure test. The downhole tool may be secured in position during the pressure test via the wellhead or remotely operated casing slips that anchor the downhole tool within the cased well 300.

Figure 5:
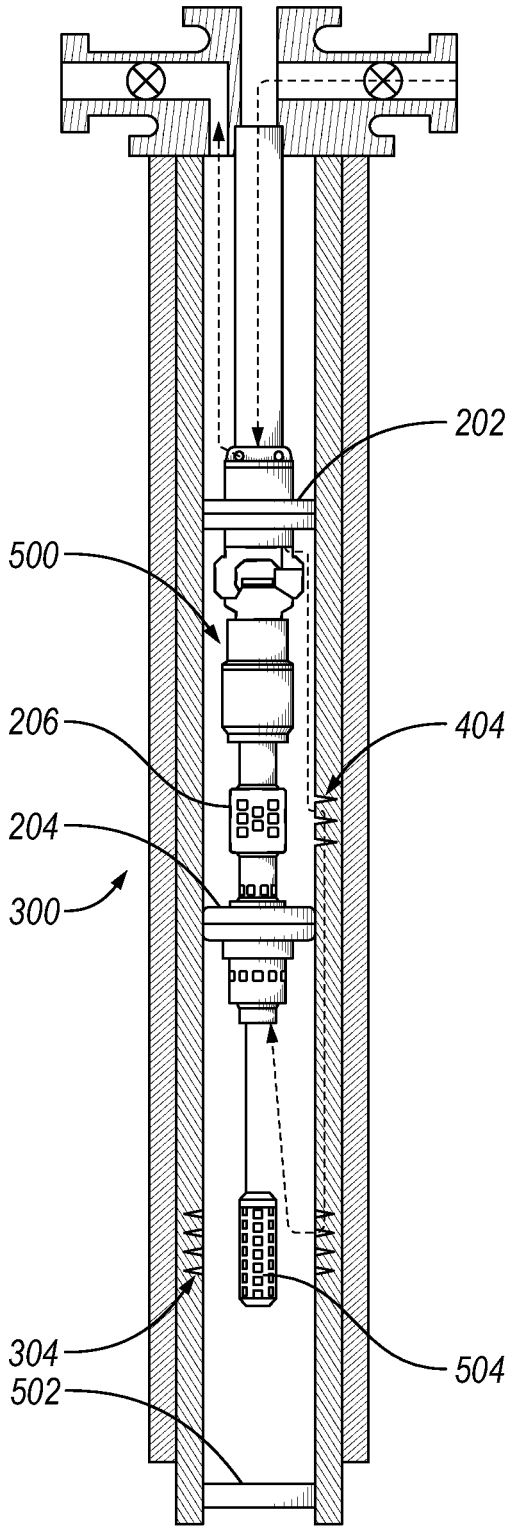
FIG. 5 is a schematic view of a downhole tool in a cased well, according to one or more embodiments.

Turning now to FIG. 5, FIG. 5 is a schematic view of a downhole tool 500 in a cased well 300. FIG. 5 includes many features that are similar to the features described above with reference to FIGS. 3 and 4. Accordingly, such features will not be described again in detail, except as necessary for the understanding of the downhole tool 500 shown in FIG. 5.

As shown in FIG. 5, the downhole tool 500 does not include a detachable isolation packer on the downhole end of the tool. Instead, the downhole tool 500 is intended to be used in situations where a lower fluid barrier 502 is already in place. The downhole tool 500 includes a second perforating gun 504 coupled to the downhole end of the downhole tool 500.

In operation, the downhole tool 500 is lowered to the desired location within the cased well 300 and the upper resettable packer 202 is set within the cased well 300. The charges within the perforating guns 206, 504 are then detonated to perforate the casing at the first perforation location 304 and the second perforation location 404. The lower resettable packer 204 is then set and the cement plug is created as described above.

Further examples include:

Example 1 is a plugging system for plugging a cased well in a single trip downhole. The plugging system includes a tool string positionable within the cased well and including a bore and a downhole tool coupled to the tool string. The downhole tool includes a first perforating gun, an upper resettable packer, a lower resettable packer, and a flow-through assembly. The first perforating gun is operable to perforate the casing of the cased well. When the downhole tool is positioned in the cased well, the upper resettable packer is uphole of the first perforating gun. When the downhole tool is positioned in the cased well, the lower resettable packer is downhole of the first perforating gun. The flow-through assembly is positioned between the upper resettable packer and the lower resettable packer and operable to flow fluids into a bore of the cased well.

In Example 2, the embodiments of any preceding paragraph or combination thereof further include wherein the first perforating gun comprises two sets of charges.

In Example 3, the embodiments of any preceding paragraph or combination thereof further include wherein the downhole tool comprises a second perforating gun that, when the tool string is positioned in the cased well, is downhole of the lower resettable packer.

In Example 4, the embodiments of any preceding paragraph or combination thereof further include wherein the first perforating gun and the second perforating gun each comprise two sets of perforating charges.

In Example 5, the embodiments of any preceding paragraph or combination thereof further include wherein the tool string includes coiled tubing.

In Example 6, the embodiments of any preceding paragraph or combination thereof further include a connector coupled to the tool string and operable to couple to a wellhead of the cased well.

In Example 7, the embodiments of any preceding paragraph or combination thereof further include wherein the downhole tool further includes a detachable isolation packer that, when the tool string is positioned in the cased well, is downhole of the lower resettable packer.

In Example 8, the embodiments of any preceding paragraph or combination thereof further include a pumping system operable to pump the cement through the flow-through assembly and into the cased well via the tool string to create a plug.

Example 9 is method of plugging a cased well in a single downhole trip of a downhole tool. The method includes lowering the downhole tool within a cased well using a tool string. The method also includes setting an upper resettable packer of the downhole tool in the cased well at a location uphole of a first perforation location. The method further includes perforating casing of the cased well at the first perforation location with the downhole tool. The method also includes perforating the casing at a second perforation location via the downhole tool. The method further includes setting a lower resettable packer of the downhole tool in the cased well at a location between the first perforation location and the second perforation location. The method also includes pumping cement through the downhole tool and into an annulus of the cased well via the perforations in the casing at the second location to create a plug.

In Example 10, the embodiments of any preceding paragraph or combination thereof further include setting a detachable isolation packer at a location downhole of the lower packer prior to perforating the cased well.

In Example 11, the embodiments of any preceding paragraph or combination thereof further include coupling a connector of the tool string to a wellhead of the cased well.

In Example 12, the embodiments of any preceding paragraph or combination thereof further include perforating the cased well at the first perforation location further comprises perforating with a first perforating gun of the downhole tool. The method also includes perforating the cased well at the first perforation location further comprises perforating with a second perforating gun of downhole tool.

In Example 13, the embodiments of any preceding paragraph or combination thereof further include wherein perforating the cased well at the first perforation location further comprises perforating with a first charge of a perforating gun of the downhole tool. Further, perforating the cased well at the second perforation location further comprises perforating with a second charge of the perforating gun.

In example 14, the embodiments of any preceding paragraph or combination thereof further include unsetting the upper resettable packer. The method also includes moving the downhole tool to the second perforation location. The method further includes resetting the upper resettable packer with the downhole tool at the second perforation location.

In Example 15, the embodiments of any preceding paragraph or combination thereof further include pressure testing the plug after the cement has set.

Example 16 is a downhole tool for use in plugging a cased well with a casing in a single trip downhole. The downhole tool includes a first perforating gun, an upper resettable packer, a lower resettable packer, and a flow-through assembly. The first perforating gun is operable to perforate the casing of the cased well. When the downhole tool is positioned in the cased well, the upper resettable packer is uphole of the first perforating gun. When the downhole tool is positioned in the cased well, the lower resettable packer is downhole of the first perforating gun. The flow-through assembly is positioned between the upper resettable packer and the lower resettable packer and operable to flow fluids into a bore of the cased well.

In Example 17, the embodiments of any preceding paragraph or combination thereof further include wherein the first perforating gun includes two sets of perforating charges.

In Example 18, the embodiments of any preceding paragraph or combination thereof further include wherein the downhole tool comprises a second perforating gun that, when the downhole tool is positioned in the cased well, is downhole of the lower resettable packer.

In Example 19, the embodiments of any preceding paragraph or combination thereof further include wherein the first perforating gun and the second perforating gun each include two sets of perforating charges.

In Example 20, the embodiments of any preceding paragraph or combination thereof further include a detachable isolation packer that, when the downhole tool is positioned in the cased well, is downhole of the lower resettable packer.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," or similar language means that a particular feature, structure, or characteristic described in connector with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A plugging system for plugging a cased well comprising a casing comprising a bore in a single trip downhole, the plugging system comprising:

a tool string positionable within the cased well; and a downhole tool coupled to the tool string, the downhole tool comprising:

an upper resettable packer immovably fixed axially in an axial position with respect to the downhole tool;

a perforating gun located downhole from the upper resettable packer when positioned in the cased well and operable to perforate the casing of the cased well with the upper resettable packer in the axial position;

a lower resettable packer that, when the downhole tool is positioned in the cased well, is downhole of the perforating gun; and a flow-through assembly axially fixed with respect to, and positioned internally across, the upper resettable packer and configured to allow fluid flow into the bore of the cased well with the upper resettable packer still in the axial position and while maintaining the position of the flow-through assembly relative to the upper resettable packer.

2. The plugging system of claim 1, wherein the first perforating gun comprises two sets of charges.

3. The plugging system of claim 1, wherein the downhole tool comprises a second perforating gun that, when the tool string is positioned in the cased well, is downhole of the lower resettable packer.

4. The plugging system of claim 3, wherein the first perforating gun and the second perforating gun each comprise two sets of perforating charges.

5. The plugging system of claim 1, wherein the tool string comprises coiled tubing.

6. The plugging system of claim 1, further comprising a connector coupled to the tool string and operable to couple to a wellhead of the cased well.

7. The plugging system of claim 1, wherein the downhole tool further comprises a detachable isolation packer that, when the tool string is positioned in the cased well, is downhole of the lower resettable packer.

8. The plugging system of claim 1, further comprising a pumping system operable to pump cement through the flow-through assembly and into the cased well via the tool string to create a plug.

9. A method of plugging a cased well in a single downhole trip of a downhole tool, the method comprising:

lowering the downhole tool within a cased well using a tool string;

setting an upper resettable packer of the downhole tool in the cased well at a location uphole of a first perforation location, the upper resettable packer being immovably fixed axially in an axial position with respect to the downhole tool;

perforating casing of the cased well at the first perforation location with the downhole tool with the upper resettable packer in the axial position;

perforating the casing at a second perforation location via the downhole tool;

setting a lower resettable packer of the downhole tool in the cased well at a location between the first perforation location and the second perforation location; and pumping cement through the downhole tool, out into a bore of the cased well through a flow-through assembly axially fixed with respect to and positioned internally across the upper resettable packer, and into an annulus of the cased well via the perforations in the casing at the second perforation location to create a plug, while the upper resettable packer remains in the axial position and the flow-through assembly remains in position relative to the upper resettable packer.

10. The method of claim 9, further comprising setting a detachable isolation packer at a location downhole of the lower resettable packer prior to perforating the cased well.

11. The method of claim 9, further comprising coupling a connector of the tool string to a wellhead of the cased well.

12. The method of claim 9, wherein:

perforating the cased well at the first perforation location further comprises perforating with a first perforating gun of the downhole tool; and perforating the cased well at the first perforation location further comprises perforating with a second perforating gun of downhole tool.

13. The method of claim 9, wherein:

perforating the cased well at the first perforation location further comprises perforating with a first charge of a perforating gun of the downhole tool; and perforating the cased well at the second perforation location further comprises perforating with a second charge of the perforating gun.

14. The method of claim 9, further comprising:

unsetting the upper resettable packer;

moving the downhole tool to the second perforation location; and resetting the upper resettable packer with the downhole tool at the second perforation location.

15. The method of claim 9, further comprising pressure testing the plug after the cement has set.

16. A downhole tool for use in plugging a cased well with a casing comprising a bore in a single trip downhole, the downhole tool comprising:

an upper resettable packer that is immovably fixed axially in an axial position with respect to the downhole tool;

a perforating gun located downhole from the upper resettable packer when positioned in the cased well and operable to perforate the casing of the cased well with the upper resettable packer in the axial position;

a lower resettable packer that, when the downhole tool is positioned in the cased well, is downhole of the first perforating gun; and a flow-through assembly axially fixed with respect to, and positioned internally across, the upper resettable packer and configured to allow fluid flow into the bore of the cased well with the upper resettable packer still in the axial position and while maintaining the position of the flow-through assembly relative to the upper resettable packer.

17. The downhole tool of claim 16, wherein the first perforating gun comprises two sets of perforating charges.

18. The downhole tool of claim 16, wherein the downhole tool comprises a second perforating gun that, when the downhole tool is positioned in the cased well, is downhole of the lower resettable packer.

19. The downhole tool of claim 18, wherein the first perforating gun and the second perforating gun each comprise two sets of perforating charges.

20. The downhole tool of claim 16, further comprising a detachable isolation packer that, when the downhole tool is positioned in the cased well, is downhole of the lower resettable packer.

* * * * *